US005172844A

United States Patent [19]

Mueller

[11] Patent Number: 5,172,844

[45] Date of Patent: Dec. 22, 1992

[54] METHOD AND APPARATUS FOR REDUCING A TRANSPORTING STRAIN ON ELONGATED MATERIAL PASSING THROUGH A TREATMENT CHAMBER

[75] Inventor: André Mueller, Ferrette, France

[73] Assignee: Bandfabrik Breitenbach AG, Breitenbach, Switzerland

[21] Appl. No.: 841,282

[22] Filed: Feb. 24, 1992

Related U.S. Application Data

[63] Continuation of Ser. No. 467,609, Jan. 19, 1990, abandoned.

[30] Foreign Application Priority Data

Jan. 21, 1989 [DE] Fed. Rep. of Germany ..... 3901782

[51] Int. Cl.[5] ..... B65H 23/00

[52] U.S. Cl. ..... 226/97; 226/119; 226/197; 226/7; 34/10; 34/156

[58] Field of Search ..... 226/7, 97, 197, 196, 226/119; 242/182, 183; 34/156, 160, 10

[56] References Cited

U.S. PATENT DOCUMENTS

| | | | |
|---|---|---|---|
| 3,826,416 | 7/1974 | Takagi et al. | 226/197 X |
| 4,134,559 | 1/1979 | Dyllus et al. | 226/97 |
| 4,197,972 | 4/1980 | Daane | 226/197 X |
| 4,247,993 | 2/1981 | Lindstrom | 226/97 X |
| 4,282,998 | 8/1981 | Peekna | 226/97 |
| 4,342,413 | 8/1982 | Reba | 226/197 X |
| 4,453,709 | 6/1984 | Reba | 226/97 X |
| 4,672,841 | 6/1987 | Schuster et al. | 226/97 X |
| 4,790,468 | 12/1988 | Nakashima et al. | 226/97 |
| 4,837,946 | 6/1989 | Hella et al. | 226/97 X |
| 4,938,404 | 7/1990 | Helms et al. | 226/197 X |

FOREIGN PATENT DOCUMENTS

| | | | |
|---|---|---|---|
| 1215465 | 4/1966 | Fed. Rep. of Germany . | |
| 1774245 | 7/1971 | Fed. Rep. of Germany . | |
| 2925985 | 1/1980 | Fed. Rep. of Germany . | |
| 2932794 | 3/1980 | Fed. Rep. of Germany . | |
| 0970871 | 9/1964 | United Kingdom | 226/97 |
| 1016703 | 1/1966 | United Kingdom . | |
| 1307695 | 2/1973 | United Kingdom . | |

*Primary Examiner*—Daniel P. Stodola
*Assistant Examiner*—Paul Bowen
*Attorney, Agent, or Firm*—W. G. Fasse; D. H. Kane, Jr.

[57] ABSTRACT

Thin, elongated material, such as ribbons, tapes, and the like, are passed through a treatment zone or chamber substantially in a frictionless manner to avoid distorting the elongated material. This purpose is achieved in that a plurality of direction changing stations in a treatment chamber simultaneously function as transport stations. The transport is accomplished by a flowing transport fluid which is applied to the elongated material through at least one, preferably several jet nozzles in the direction reversing stations. The fluid is applied in a direction substantially corresponding to the transport direction and passes around a guide surface where it forms a travelling cushion between the guide surface and the elongated material. The flow speed of the fluid corresponds at least to the transport speed or the inlet speed into the chamber. Each direction changing station includes a guide body having a surface around which the elongated material is guided from an inlet side of the guide body to its outlet side. Each station includes the above mentioned nozzles through which the transport fluid is flowing under pressure to form the required jet speeds between the guide surface and a surface of the elongated material.

40 Claims, 5 Drawing Sheets

METHOD AND APPARATUS FOR REDUCING A TRANSPORTING STRAIN ON ELONGATED MATERIAL PASSING THROUGH A TREATMENT CHAMBER

This application is a continuation of application Ser. No. 07/467,609, filed on Jan. 19, 1990, now abandoned.

FIELD OF THE INVENTION

The invention relates to a method and apparatus for reducing a transporting strain on elongated material passing through a treatment chamber.

BACKGROUND INFORMATION

Elongated material in the present context may include ribbons, tapes, band-shaped material, for example, made of textiles, synthetic materials, or paper. The term also includes threads, yarns, ropes, strings, and the like. Such materials frequently require a treatment in a treatment chamber. For this purpose, the elongated materials must be transported through the treatment chamber passing through an inlet into the chamber and through an outlet out of the chamber. Inside the chamber or treatment zone the surface of the elongated material passes along the surface of at least one guide body which changes the travel direction of the elongated material through the treatment zone or chamber. The material to be treated usually travels through the treatment zone along a meandering path, for example, for the purpose of drying or dyeing or impregnating or the like. The conventional direction changing guide body is usually a rotatably mounted roller which is either positively driven or it rotates as a result of the contact of its surface with the material being treated.

In order to transport the material through the treatment chamber or zone, it was necessary heretofore, to provide a positive drive. Such positive drive may involve the driving of the guide rollers and/or a further drive which pulls the elongated material through the treatment chamber or zone. In all conventional transport drives of this type it is unavoidable that the elongated material is subjected to a substantial transporting strain caused by a longitudinally effected stress applied by the pulling force of a take-up reel or the like. The direction reversing guide rollers inside the treatment chamber are mounted in a fixed position, except one such roller is mounted in a floating manner to provide for some yielding, whereby the elongated material is protected to some extent against too large tension stress. Thus, when the take-up roller rotates too fast, the floating roller travels out of its original position into a position in which the total length of elongated material within the treatment zone or chamber is reduced. This movement direction of the floating roller is maintained, for example, until a predetermined threshold tensile stress is reached in response to which, for example, an end switch or sensor switch provides a signal for the control of the feed advance. Such a signal may slow down the take-up speed or may increase the feed-in speed. As a result, the floating roller again moves in the opposite direction until a respective threshold value is sensed. The feed advance is thus controlled to provide for a back and forth shuttling of the floating guide roller between presettable limit values for the tensile stress applied to the material.

In spite of such a floating guide roller it is unavoidable, that the type of material hereinvolved may be exposed to relatively large tension stress during its transport through a treatment zone or chamber. This is due to the fact that the material being transported must take up at least that stress that is necessary for moving the floating guide roller. To this stress is added a stress component necessary for rotating any guide rollers mounted in a stationary, but rotatable position. Even if the stationarily mounted guide rollers are positively driven, there may be synchronization errors that also result in undesirable tensions on the elongated material. Even the friction in the bearings of guide rollers that are rotating due to the contact with the elongated material results in undesirable tension stress which may differ from roller to roller and which adds up with the number of rollers. Exposing the elongated material to such tension stress is undesirable because it adversely influences the quality of the finished elongated material. This problem has not been solved heretofore.

OBJECTS OF THE INVENTION

In view of the foregoing it is the aim of the invention to achieve the following objects singly or in combination:

to reduce the above described tension stress to which materials of the mentioned type are exposed in their treatment while still transporting the material uniformly and at the desired speed through the treatment zone or chamber;

to transport the material by means of a blowing medium which substantially reduces the application of tension stress, possibly to the extent that at the take-up end of the elongated material a pulling mechanism can be avoided;

to support the elongated medium on a transporting cushion of flowing fluid; and to provide a transport for the elongated material with a minimum of stress independently of the fact that the treatment may somewhat lengthen the material or that the treatment may shorten the material, e.g. by stretching or shrinking.

SUMMARY OF THE INVENTION

The invention achieves the above objects by transporting the elongated material on a fluid flow which is introduced between a surface of a guide means and the surface of the elongated material, whereby the flowing fluid is directed at least approximately in the transport direction. The flowing fluid has a flow speed corresponding at least to the transporting speed or at least to the inlet speed of the material into the treatment zone or chamber.

The flowing medium generates a cushion at each location where the travel direction of the elongated material is changed. The cushion is produced between the surface of a direction changing or direction reversing guide body and the surface of the material facing the guide body surface. Thus, the elongated material can float on such a cushion and is transported by the flowing cushion substantially free of friction. This type of transport completely avoids the need for direction changing guide rollers regardless whether they are of the driven or undriven type. The direction reversing guide body may be stationary and rigid but it must have a smooth surface of the suitable curvature to achieve the direction change or reversal, whereby the radius of curvature can be selected in a very wide range. Provided the direction reversal is performed several times in the treatment zone or chamber, it is now also possible to avoid the above mentioned floating roller.

The above mentioned floating of the elongated material on the cushion of flowing fluid which simultaneously transports the elongated material, can be enhanced by additionally introducing flowing fluid between the elongated material and an exit guide plane, for example, in the form of a baffle plate, whereby again the flowing fluid must have a suitable flowing speed. Due to the low friction between the material and the flowing fluid it is possible to even shrink the elongated material in the treatment chamber or zone without generating any tension stress in the elongated material in the transport direction. Thus, even where a shrinking takes place as part of the treatment of the elongated material, a take-up roller downstream of the treatment zone or chamber is no longer necessary since the flowing fluid performs the transport regardless whether the elongated material is shrinking or even expanding. It is also no longer necessary to correlate the input speed to the output speed. Nevertheless, the transport is uniform and tension stress is avoided because the infeed and withdrawal of material no longer depends on friction contact within the treatment zone. As much material as necessary can be fed into the treatment zone or chamber and as much material can be taken out as is necessary. If the feed-in speed should be reduced at the inlet end of the chamber, such reduction does not have any noticeable effect on the quality of the elongated material because it does not affect any tension stress within the material travelling through the treatment zone or chamber.

By varying the density of the flowing fluid with due regard to the density of the medium forming the environment in the treatment chamber, it is possible to influence the treatment. The flowing transport fluid and the treatment medium may both be gaseous or both may be liquid or one may be gaseous and the other liquid. The flowing fluid may contain additives for the treatment of the elongated material. The flowing fluid could be heated or it could be cooled, whereby again the desired influence on the elongated material may be achieved. The density of the flowing fluid could have a density that is larger, smaller or equal to a density of a medium such as air normally present in the treatment chamber.

Frequently, it is suitable that the flowing fluid and the treatment or environmental medium in the treatment zone, have substantially the same composition, whereby intermixing is of little concern and any need for any separation of components subsequent to the treatment is avoided.

Depending on the type of transport intended, it is possible according to the invention to apply different flowing speeds to the flowing transport fluid at the individual direction changing guide bodies. For example, the flowing speed may increase from guide body to guide body. Different flowing fluids may be used at different guide bodies and the density of the flowing fluid may be different at different guide bodies. These features make it possible to take into account the characteristics of the elongated material as they may change along the pass of the material through the treatment chamber or zone. For example, if the elongated material should lengthen as a result of the treatment, it is necessary to increase the transport speed from the inlet of the treatment chamber toward the outlet of the treatment chamber to properly transport the increasing length of the elongated material. Similarly, if the material should shrink as a result of the treatment, it is possible to reduce the transport speed from the inlet to the outlet. In all instances it is advantageous to avoid directing the flowing transport fluid in a direction radially to the length of the material to thereby avoid any distortions in the material.

In the light of the foregoing it will be appreciated that the flow speed of the flowing transport fluid can influence the transport speed of the elongated material. However, the transport speed also depends on the surface characteristics of the material and on the density of the flowing transport fluid. Normally, the transport speed of the elongated material will be smaller than the flow speed of the flowing transport fluid, and the transport speed can be controlled without any problems.

Another advantage of the invention is seen in that in addition to the transporting by means of the flowing fluid, a conventional transport may be combined by means of a take-up roller outside the treatment zone. Due to the reduced friction assured by the cushioning formed by the flowing transport fluid, the stress on the elongated material will be very small because the pulling forces generated by a take-up roller can be very small.

Depending on the characteristics of the elongated material it may be advantageous to apply the flowing transport fluid over the entire width of the material. However, a denser elongated material such as paper webs, can be transported when the flowing transport fluid is applied only to certain zones or even only along a center strip or only along the outer edges. Further, it may be advantageous to distribute the flow speed over the width of the elongated material so that, for example, a larger flowing speed is applied along the edges while a smaller flowing speed is effective along the center of the elongated material or vice versa. By applying an increased flowing speed along the edges it is, for example, possible to reduce an escape of flowing transport fluid away from the central zone of the elongated material, whereby undesirable force components that may be exerted by the flowing transport fluid on the elongated material, are either prevented or minimized. On the other hand, for certain materials it may be desirable to have a higher flowing speed for the flowing transport fluid along a central zone than the transport fluid speed along the edges. Such a speed distribution of the flowing transport fluid may be desirable, for example, for double ribbons having a central transport zone of a different composition than the edges so that the transporting is accomplished primarily by applying the flowing transport fluid to the central strip while the lateral edges of the elongated material are merely supported by the slower speed of the flowing transport fluid, thereby preventing a slowing down of the lateral edges of the elongated material relative to the central zone. The flowing transport fluid may be applied in the form of a plurality of individual jets having, for example, circular cross-sections or any other suitable cross sections. Instead of a plurality of individual jets, a broad flat jet may be employed which has a width corresponding to the entire width of the elongated material or which has several zones distributed across the width of the elongated material. Thus, it is possible to support the elongated material along its entire width or along certain zones.

The apparatus according to the invention for performing the present method comprises at least one guide body for changing the travel direction of the elongated material between the inlet and outlet of a treatment zone or chamber. The elongated material travels around the guide body for the direction reversal. Each guide body is equipped with at least one jet means for introducing a flowing transport fluid into a space between a surface of the guide body and the elongated material. The flowing transport fluid is introduced substantially in the travel direction. The jet means impart to the flowing transport fluid a flow speed which corresponds at least to the transporting speed of the elongated material. The flowing transport fluid may, for example, be compressed air. The compressed air forms a moving support cushion for the elongated material, thereby keeping the elongated material substantially in a floating condition so that the latter may travel substantially free of friction around the guide body while the flowing fluid transports the elongated material. Thus, a substantial pulling force does not have to be applied to the elongated material, nor is it necessary that the elongated material entrains any guide rollers for rotating the guide rollers. By substantially reducing the friction and hence the pulling forces on the elongated material, it is possible to transport the elongated material through its treatment zone or chamber substantially without any distorting influences.

The jet means for introducing the flowing transport fluid comprise advantageously at least one nozzle which is arranged at a spacing from the point where the change in the transport direction begins to take place, whereby such spacing extends substantially in the transport direction upstream of said point. The nozzle is so directed that the flowing transport fluid is aimed tangentially toward said point. The nozzle may, for example, be of the type capable of producing a so-called flat section jet. Such jet has a flat ribbon-type cross-section. However, other nozzle types may be used, for example, groups of nozzles may be arranged in a row across the entire width of the elongated material to be transported. One or several nozzle groups may be arranged in this manner. Preferably, each group is arranged along a straight line across the width of the material. All nozzles in a row may produce fluid jets all having the same cross-section or a different cross-section, thereby generating transport jets having the same cross-sectional flow area or different cross-sectional flow areas. In the embodiment where several nozzles produce several different jets, these jets may be produced by transport fluids under different pressures or by transport fluids having different densities or other different characteristics. However, depending on the type of material being transported and treated, it is quite possible to supply the same transport fluid by a common source under pressure to all nozzles. Where a common source of fluid under pressure is used, the nozzles may be arranged in a side wall of a tubular member having a rectangular or square cross-section, whereby the nozzles are simply bores located in said side wall close to a neighboring or adjacent wall forming part of the guide body for changing the travel direction.

By using different types of nozzles and nozzle shapes and by different nozzle arrangements it is possible according to the invention to vary the influence of the flowing transport fluid on the elongated material. The variation is accomplished by properly selecting a desired nozzle configuration or nozzle shape and the respective fluid flow is then effective on the elongated material during its transport through the treatment zone or chamber. Thus, it is, for example, possible to transport a sensitive thin elongated material, such as a fabric that is homogeneous in its cross-sectional structure, by a flat transport jet without any problems, and without substantially any distorting influences of the flat jet stream on the sensitive thin fabric. A quite similar result is achieved by arranging a plurality of nozzles in the form of a row of bores, whereby the flat jet stream is replaced by a plurality of small diameter individual jet streams. The plurality of nozzles can simply be provided by the above mentioned bores arranged in a side wall of a rectangular cross-section or square cross-section pipe resulting in a very simple structure.

By applying the pressurized transport fluid in a controlled manner to individual nozzles or to groups of such nozzles, it is also possible to influence the effect of the flowing transport fluid on the elongated material. In this context it is possible to vary individually or in combination the fluid pressure, the fluid density, the fluid composition, and/or the fluid temperature. Thus, the influence on the transporting can be modified in a multitude of ways to assure that the elongated material is substantially free of distortions while simultaneously using the transporting fluid as a treatment medium, for example, for impregnating or drying the elongated material. The present transport and its multitude of control possibilities is equally applicable to elongated material not having a homogeneous cross-sectional structure. For example, fabric ribbons may be denser along their edges and less dense in a central area between the edges. Similarly, the density may change along the length of such fabric ribbons. The present transport fluid can be controlled to take into account these characteristics of elongated material. For example, a ribbon with denser or thicker marginal zones will require a higher flowing speed along these denser or thicker zones as compared to the flowing speed of the transport fluid contacting a central zone of the ribbon. Thus, the proper adjustment of the several flowing speeds with due regard to the ribbon characteristics will assure that the marginal zones will not be displaced relative to a central zone so that again the transport takes place substantially without any distortion of the ribbon being transported.

The guide body for changing or reversing the travel direction of the elongated material is, for example, made of sheet metal which provides a simple and relatively inexpensive way of producing these guide bodies. The wall portion of the guide body where a direction change or reversal begins, must have a suitable spacing from the outlet openings of the nozzle or nozzles. Thus, the guide wall extends perpendicularly or at a small angle to a nozzle wall of the guide body. The nozzle wall portion reaches beyond the guide wall portion so that the nozzles face in a direction approximately in parallel to the guide wall portion. Thus, the flowing transport fluid travels toward the point of direction change substantially in a tangential direction. The arrangement is such, that the guide wall portion and the flowing fluid facing surface of the elongated material form a wedge shape which in itself also forms a type of nozzle into which the transport fluid is blown since the wedge shape narrows toward the point of the direction change. For example, when elastic elongated materials for forming bandages are to be transported, it is desirable to direct the transport flow substantially in parallel to the guide wall portion of the guide body at least at the point where a change in the travel direction begins. This may be accomplished by changing the angle between the guide wall portion and the nozzle portion of the guide body from 90° to an angle smaller than 90° to provide for a more rapid reduction in the cross-sectional flow area in the nozzle channel formed by the wedge-shape, so that the channel narrows quickly toward the point of direction change. In this manner, the direction of the transport fluid and the direction of travel may substantially correspond to each other. The radius of curvature for a guide body wall portion intended for transporting such flexible bandage material, may have a radius of curvature of about 10 mm. As a result, the entire apparatus can be rather compact, even though the guide body is required to provide a complete direction reversal of 180°. In such an instance the guide surface portion will have a semi-circular cross-section. According to the invention the nozzle or nozzles at each guide body can be controlled in accordance with the conditions prevailing at the particular guide body. Thus, it is, for example, possible to provide a sensitive adaptation of the transport speed to any shrinking or stretching of the elongated material at the particular guide body within the treatment zone. For this purpose, a speed sensor may be arranged just upstream of the respective guide body, as viewed in the transport direction, the respective signal from the speed sensor is then used by a central processing unit for controlling the flow speed of the transport fluid. On the other hand, all nozzles can be centrally controlled in unison, rather than individually.

BRIEF DESCRIPTION OF THE DRAWINGS

In order that the invention may be clearly understood. it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
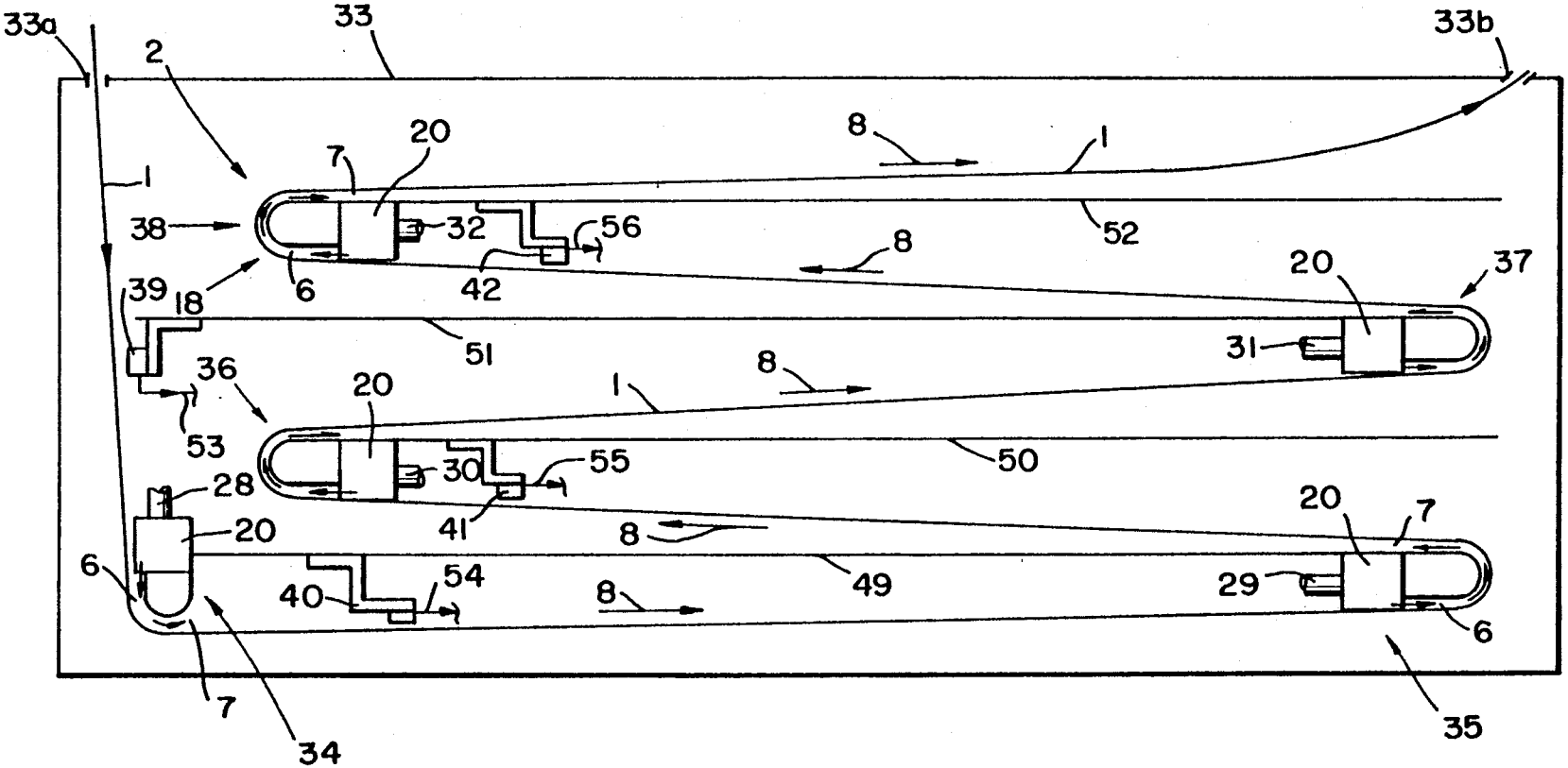
FIG. 1 is a schematic sectional view through a treatment chamber equipped with a plurality of guide bodies, each of which is provided with its transport nozzles for moving the elongated material through the treatment chamber by a fluid flow.

FIG. 1 illustrates schematically a longitudinal section through a treatment chamber 33 defining a treatment zone 2 within the chamber. The chamber 33 has an inlet 33*a* and an outlet 33*b* for the elongated material 1, such as a ribbon or the like. Inside the chamber 33 opposite the inlet 33*a* there is mounted a first direction changing station 34 which imparts to the ribbon 1 a directional change of about 90°. The ribbon 1 travels through the chamber 33 in the direction indicated by the arrows 8. Downstream of the guide station 34, as viewed in the travel direction of the ribbon 1, there is a further guide station 35 imparting to the ribbon 1 substantially a direction reversal of about 180°. The ribbon 1 then meanders back and forth horizontally in the chamber 33 as guided by further guide stations 36, 37, and 38.

Although the inlet 33*a* and the outlet 33*b* are shown in FIG. 1 on the same side of the chamber 33, this construction is not necessary for embodying the present teaching. Such an arrangement may be convenient, but not absolutely necessary.

The guiding of the ribbon 1 along a meandering path as shown in FIG. 1, permits introducing into the treatment zone 2 a sufficient quantity of ribbon for a uniform treatment while still keeping the volume of the chamber 33 relatively compact. The meandering also exposes the material to a relatively long path within the treatment chamber 2, whereby the residence time within the treatment zone 2 can be maintained sufficiently long for the desired treatment, even if the travel speed through the chamber 33 is relatively high.

Guide plates 49, 50, 51, and 52 are mounted within the chamber 33 for separating the treatment zone 2 into several sections. Conventional speed sensors 39, 40, 41, and 42 are mounted within the chamber 33 in such positions that the speed of the ribbon 1 can be measured. For this purpose, the ribbon 1 may, for example, be provided with markers equally spaced along the length of the ribbon and the sensors count the number of markers passing per unit of time, thereby providing a speed signal. In another speed sensor, the ribbon may drive a wheel for generating a speed signal. In any event, conductors 53, 54, 55, and 56 connect the respective speed sensor to a central processing unit 48 shown in FIG. 6. The CPU 48 processes the speed signals in accordance with a program stored in a memory 48*a* of the CPU 48 for producing control impulses to be supplied to control valves 43, 44, 45, 46, and 47 also shown in FIG. 6. These control valves are, for example, electromagnetically operated valves connected through control conductors 57 to 61 to respective outputs of the CPU 48.

Figure 6:
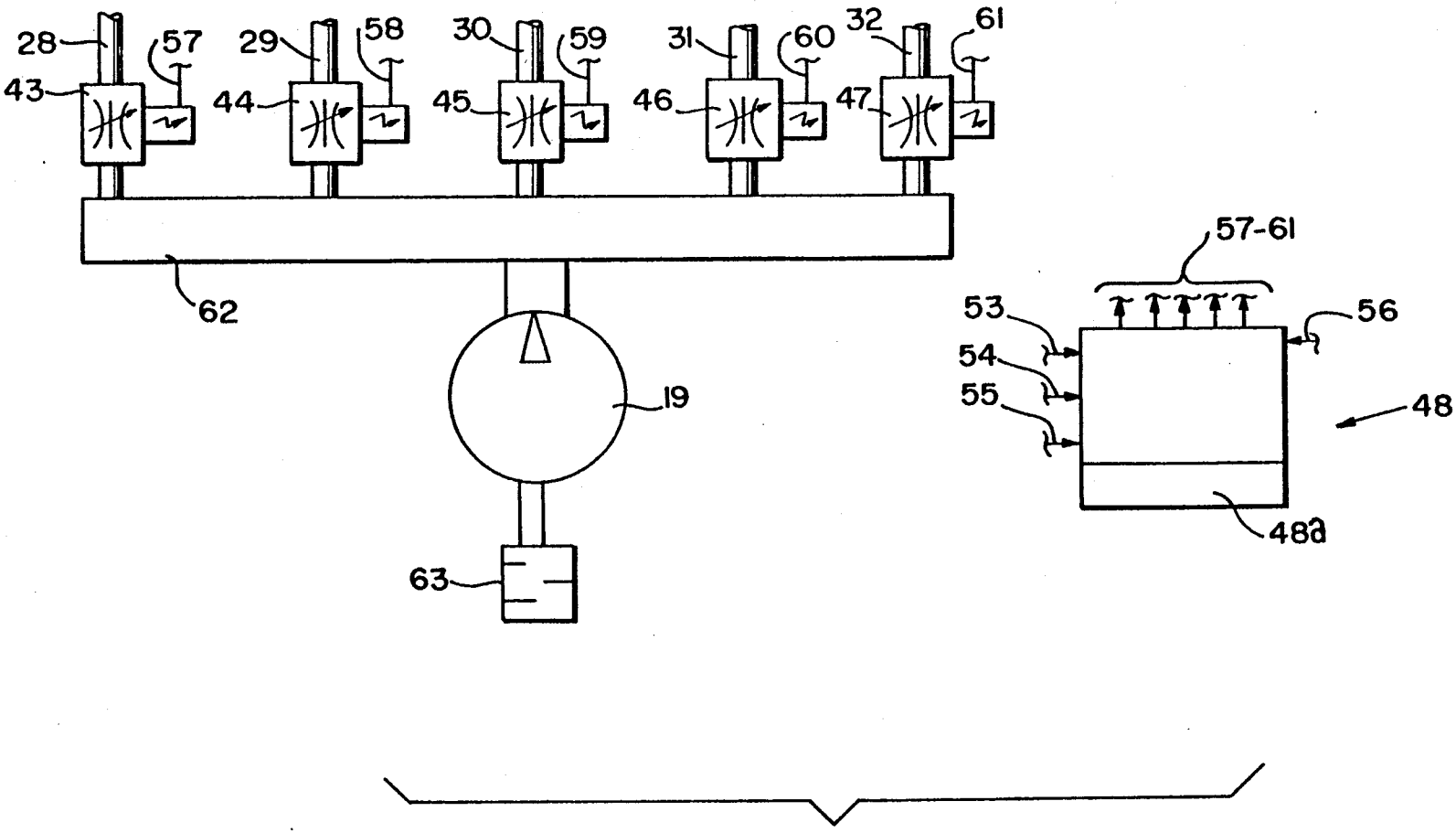
FIG. 6 illustrates schematically a flow control system for the supply of pressurized transport fluid to individual nozzles with the aid of a central processing unit.

Referring further to FIG. 6, the valves 43 to 47 are volume control valves connected through pipes 28 to 32 to the respective guide station 34 to 38 shown in FIG. 1, or rather, to the tubular member 20 of the nozzle structure of the corresponding guide station. The volume control valves 43 to 47 are further connected to a manifold 62 which in turn is supplied with transport fluid under pressure from a compressor 19 including a drive motor not shown. The intake of the compressor 19 is connected to a noise muffler 63 if the transport fluid is a gas such as air.

Figure 2:
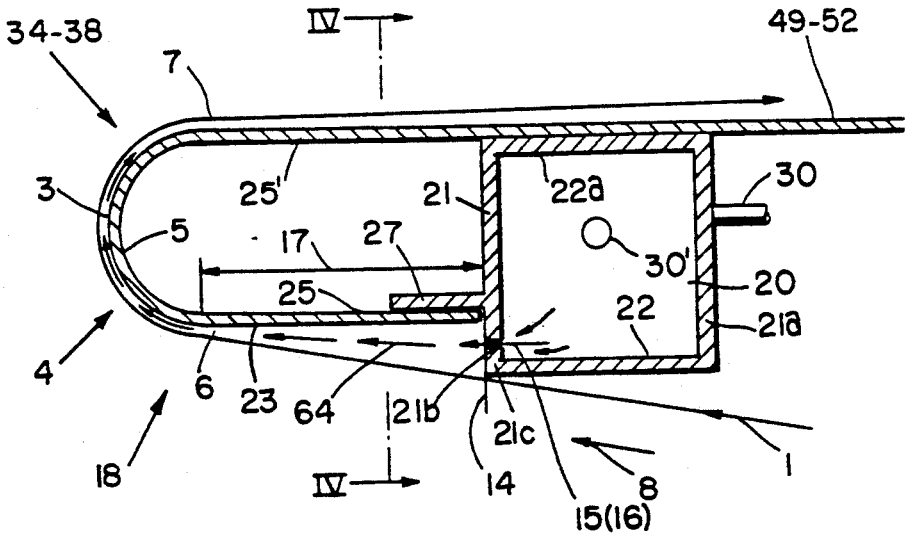
FIG. 2 is a sectional view, on an enlarged scale compared to the illustration of FIG. 1, through a guide body with its nozzle structure, whereby the section extends approximately along section line II—II in FIG. 4, or section line II—II in FIG. 5.
Figure 2A:
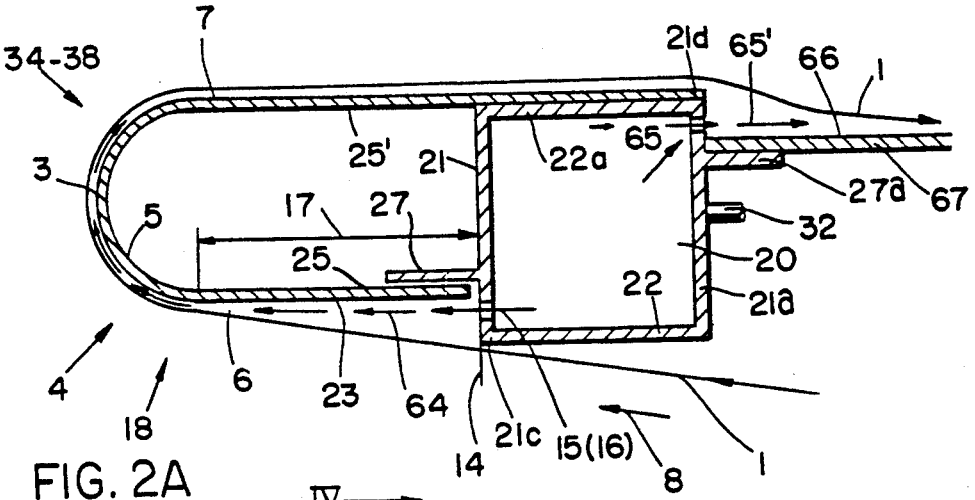
FIG. 2A shows a sectional view similar to that of FIG. 2, but illustrating a modified guide body with transport nozzles upstream and downstream of the direction changing zone of the guide body.
Figure 3:
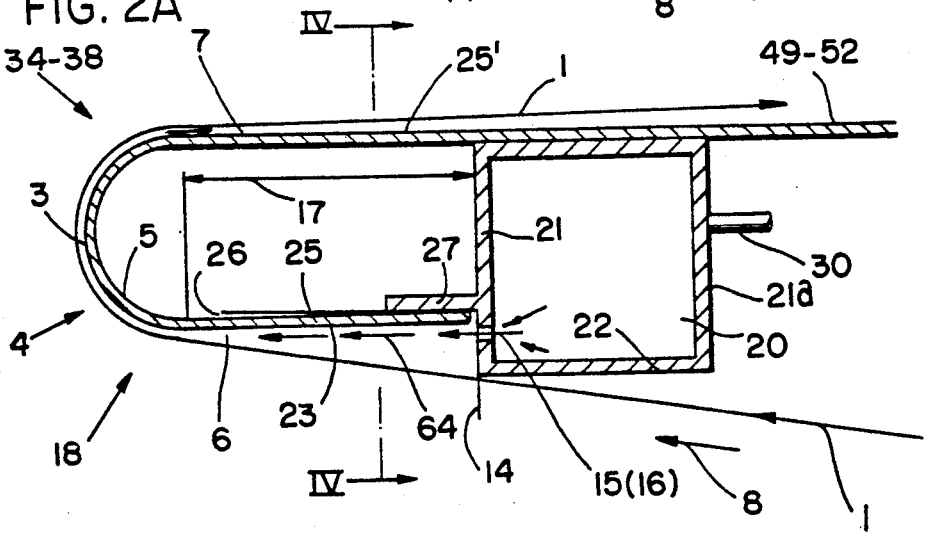
FIG. 3 is a sectional view similar to that of FIG. 2, however, showing an inclined guide leg of the guide body.
Figure 4:
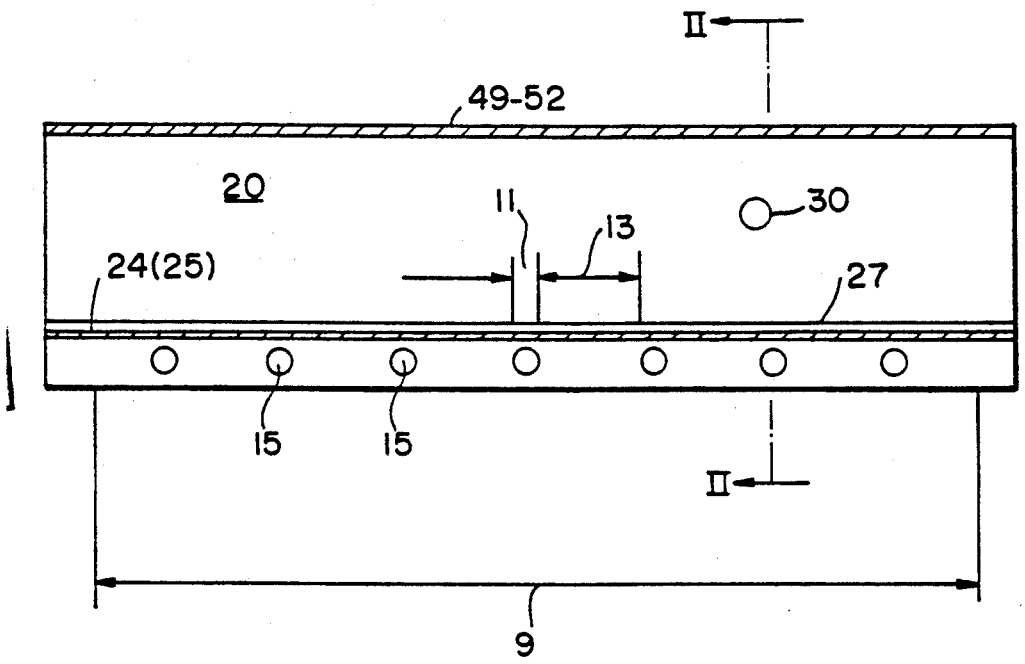
FIG. 4 is a sectional view along section line IV—IV in FIG. 2, or in FIG. 3.
Figure 5:
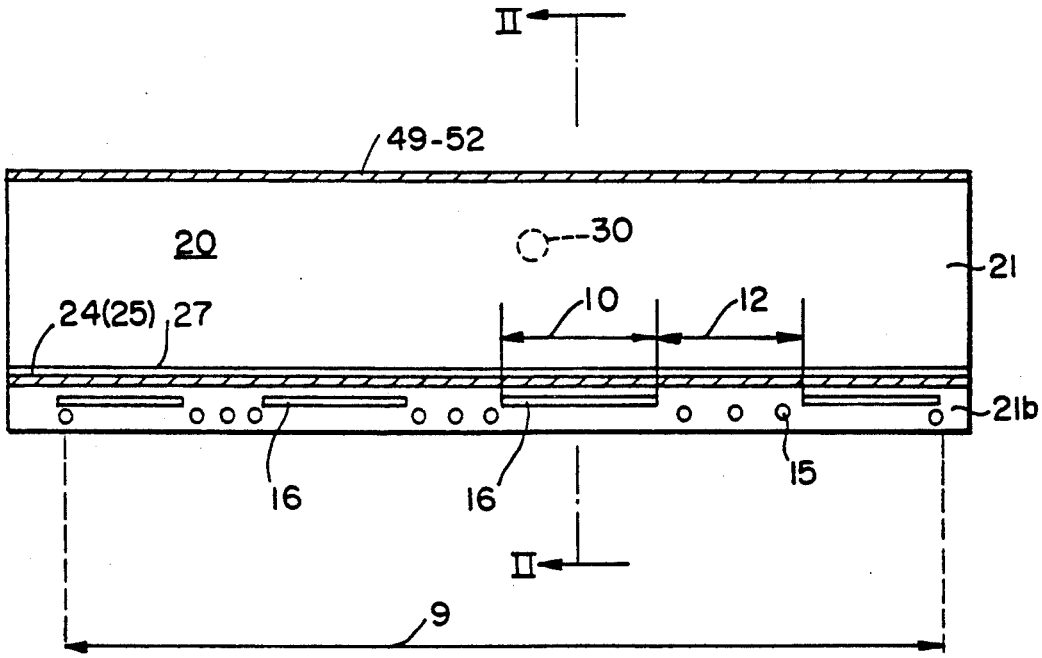
FIG. 5 is a sectional view similar to that of FIG. 4, but showing a combination of circular cross-sectional nozzles with slot cross-sectional nozzles.

Referring to FIGS. 2, 2A, and 3, each of the direction changing stations 34 to 38 comprises a tubular member 20, for example, having a rectangular cross-section and extending, for example, across the chamber 33 from one side wall to the other opposite side wall. The tubular member 20 has a first side wall 21 facing in the travel direction prior to direction reversal and a rear side wall 21*a* facing in the travel direction after direction reversal. A pipe 30 is connected through the side wall 21*a* to supply fluid under pressure into the chamber formed by the pipe 20. However, fluid under pressure may be alternatively supplied through an end wall as shown at 30'. The side wall 21 has an extension 21*b* provided with a plurality of nozzle bores 15 and/or 16, please see FIGS. 4 and 5. These nozzles 15, 16 are distributed along the entire width 9 of the elongated material 1 as seen in FIG. 5. In FIG. 4 the nozzles 15 do not extend entirely to the very edges of the material width 9. The arrangement in FIG. 4 is such that no flowing transport fluid is ejected in zones 13. On the other hand, in FIG. 5, the nozzle arrangement is such that elongated flat nozzles 16 eject the transport fluid in zones 10 while the circular cross-section nozzles 15 eject fluid in zones 12. In the zones 12 no fluid is ejected along the spacings between neighboring nozzles 15. The nozzles may be arranged in a row, preferably a linear row, as shown in FIG. 4 or in two rows as shown in FIG. 5. By changing the cross-sectional flow area and the configuration of the cross-sectional flow opening, it is possible to desirably influence the flow pattern. The nozzles 15, 16 are located in the extension 21*b* of the side wall 21 of the tubular member 20 just next to a further side wall 22 of the tubular member 20.

A contact surface 21*c* for the elongated material 1 is formed where the extension 21*b* and the lower wall 22 of the tubular member 20 meet. This contact surface 21*c* is also spaced from the zone 18 where the direction change begins around the surface 3 of a curved portion 5 of the guide body 4 having a shorter leg 25 and a longer leg 25'. The tubular member 20 has a wall extension 27 extending away, preferably at a right angle, from the side wall 21 of the tubular member 20. The extension 27 provides a stop and a means for mounting the end of the shorter leg 25 to the tubular member 20. The longer leg 25' rests on an upper wall 22*a* of the tubular member 20, whereby the outwardly facing surface of the leg 25' forms a guide surface 7 for the material 1 and may extend beyond the location of the tubular member 20 as shown in FIG. 1. The leg 25' may, for example, be welded to the wall 22*a* of the member 20. The legs 25, 25' and the curved portion 5 form a U-shape.

As described above, in the example embodiment the nozzles 15 and 16 receive the pressurized fluid from the interior of the tubular member 20 which is connected to the respective supply pipe 28 to 32 shown in FIG. 6. Where the supply pipes 28 to 32 are connected through the end walls as shown at 30', the outer chamber walls must be sealed to the ends of the tubular members 20 or vice-versa.

Referring further to FIGS. 2, 2*a*, and 3, the individual guide bodies 4 are preferably formed of sheet metal as the curved end section of the guide members 49 to 52. Preferably, the radius of curvature of the curved portion 5 is a semi-circle having a radius of, for example, 10 mm for a curvature of at least 180°. The so formed guide body 4 is then connected, as mentioned above with its leg 25 to the wall extension 27 of the tubular member 20. Thus, the outwardly facing surface 23 of the short leg 25 and the elongated material, form, or rather enclose, a wedge-shape into which the fluid under pressure is blown through the nozzles 15, 16, as indicated by the arrows 64. Due to the suction effect through the nozzles 15, 16 there is a tendency of the elongated material 1 to be drawn against the contact surface 21*c* formed at the corner between the wall extension 21*b* and the wall 22 of the tubular member 20.

FIG. 2A shows an embodiment similar to those shown in FIGS. 2 and 3, however, in FIG. 2A additional nozzles 65 are arranged in the upper right-hand corner of the tubular member 20, whereby fluid under pressure as indicated by the arrows 65' is blown along the surface 66 of a guide member 67 to further aid in the transporting of the elongated material 1. The guide member 67 is mounted with its left-hand end to a wall extension 27*a* in the same manner as was described above with reference to the end of the leg 25 that is mounted to the wall extension 27. Here again, due to the suction effect by the flowing fluid indicated by the arrow 65' there is a tendency of the elongated material 1 to contact a contact surface 21*d* of the tubular member 20.

In FIG. 3 the short leg 25 of the guide body 4 extends at a small angle 26 relative to the wall extension 27 to modify the wedge shape of the wedge space between the surface 23 and the elongated material 1. The wedge shape is such, that the widest opening into the wedge space is located in a plane 14 defined by the outer surface of the wall 21 in the extension 21*b* of which the nozzles 15, 16 are located. The narrowest section of the wedge space is located at the zone 18 where a direction change begins. The spacing 17 between the plane 14 and the zone 18 should be such that the fluid flow 64 can extend substantially tangentially to the surface of the guide body 4 at the point 18 where direction change begins. If the spacing 17 is too short, the fluid flow 64 will not coincide with the travel direction or transport direction 8 in the inlet to the zone 18. If the space 17 is too large, the speed of the fluid flow may have become too small for a proper feed advance of the elongated material 1. Further, the spacing 17 should also not be so long that an undesirable whirling of the fluid flow begins, causing a lateral expansion of the flow fluid.

In operation, the elongated material is first inserted into the chamber 33. For this purpose a side wall, functioning as a cover, is removed. Once the insertion is completed so that the elongated material 1 passes around each of the direction changing stations 34 to 38, and the chamber is closed again, transport fluid under pressure is introduced into the tubular members 24 passing through the nozzles 15 and 16 to travel in the direction of the arrows 64. The fluid under pressure pushes itself between the material 1 and the surface 3 of the curved section 5 of the guide body 4 at the point 8 where the direction change begins. The fluid under pressure keeps lifting off the material 1 from the surface 3 to form a travelling cushion between the surface 3 and the material 1. As a result, the material 1 is entrained by the fluid flow which thus transports the material 1 in the direction 8 from the inlet side 6 to the outlet side formed by the surface 7 of the guide body 4. Such transport is substantially free of friction. The number of direction changing stations will depend on the dwell time needed for the particular treatment. By varying the flow speed of the flowing transport fluid and/or by varying the mass throughput of the flowing fluid through the nozzles, it is possible to apply a transport speed to the elongated material 1 with due regard to the characteristics of the material. The influencing of the transport speed may be performed individually at each direction changing station. For this purpose the speed sensors 39 to 42 are located in proper positions to sense the speed of the material 1 at these positions and to produce respective control signals. Thus, it is possible to take into account any flexible stretching or any shrinking of the material at different points along the travelling path through the treatment zone. If the material shrinks due to the treatment, more material must be fed into the apparatus than will be carried out of the apparatus. The present control can be adjusted to such an operating condition. Similarly, if the material stretches due to the treatment, more material must be taken out of the chamber than is being passed into the chamber. Here again, a very individual adaptation of the feed advance is achieved according to the invention so that undersirable tension stress is not applied to the material 1.

In connection with the shrinking, it is, for example, known, based on experience and experiments, how much shrinking will take place. Thus, the required speed reduction in response to the shrinking is a scalar amount that is known and the speed can be controlled accordingly. The inlet speed can first be adjusted at the guide station 34 by controlling the valve 43. The so established initial speed is then sensed by the sensor 39 to provide a signal on the conductor 53 to the central processing unit 48 which now knows the speed upstream of the station 34. The further speed sensor 40 just downstream of the station 34 provides a further speed signal on the conductor 54 to the central processing unit 48. Thus, it can be ascertained first whether the station 34 indeed transports the material 1 in the direction 8 and if the speed at 39 differs from the speed at 40, a shrinking or stretching is recognized. As a result, the valve 43 can be controlled for providing the required adjustment of the flow speeds in the station 34.

If no shrinking or lengthening or stretching is noted at the inlet guide station 34, the speed measuring stations 41 and 42 still may provide further speed signals through the conductors 55 and 56 to the central processing unit to make sure that the same transport speed prevails at the respective direction changing stations to make sure that the quantity of material fed into the chamber 33 is also removed from the chamber 33, thereby providing an indication that no jamming takes place inside the chamber. However, if a shrinking does take place, the sensors 41 and 42 provide respective slower speed signals and the speed of the jets may be adjusted accordingly through the control valves 44 to 47 as controlled by the central processing unit 48 through the conductors 58 to 61. Some or all of the guide stations may be provided with their respective speed sensors upstream and/or downstream of these stations 34 to 38.

The central processing unit 48 shown in FIG. 6 has been described so far as controlling the flow control valves for the individual stations 34 to 38. However, the same control system can be applied to controlling individual nozzles at one guide station. Thus, if the material 1 does not have a homogeneous structure across its width, the individual nozzle holes 15, 16 may be connected to individual fluid flow supply pipes or hoses rather than to a common chamber in a tubular member 20 as described above. Thus, the fluid flow can be individually and sensitively controlled in accordance with the requirements of any particular type of material to be transported. In addition to controlling the flow speed, it is possible to modify the composition and density of the flowing transport fluid in order to minimize any distortion of the material to be treated.

The present method and apparatus transport the type of materials mentioned substantially free of distortions because the tension stress caused heretofore has been minimized by the described features and because the direction reversing frictional forces and/or dragging forces have been reduced to such small values that these forces can now be disregarded.

Figure 7:
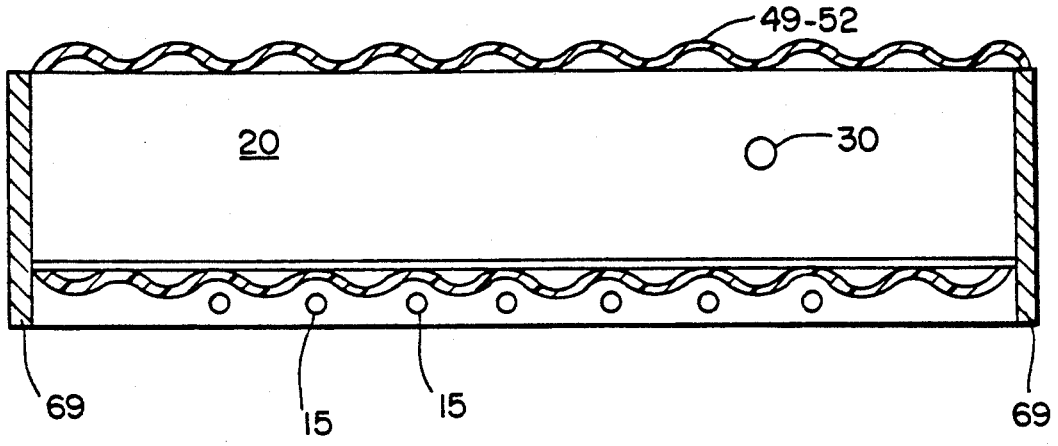
FIG. 7 is a sectional view similar to FIG. 4, illustrating a corrugated guide sheet or plate.

FIG. 7 shows a sectional view through a tubular member 20 similar to FIG. 4, but showing guide sheets or plates 49' to 52' with a corrugated cross-sectional configuration. The nozzles 15 are shown in the valleys between the ridges of the corrugation. The ends of the tubular member 20 are sealed by a seal 69 which may bear against the inner surfaces of the side walls forming part of the housing 33.

Figure 8:
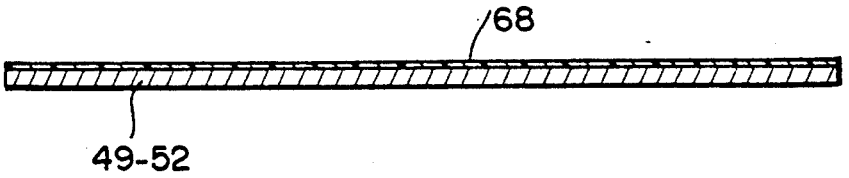
FIG. 8 is a sectional view of a surface coated guide sheet or plate.

FIG. 8 shows a section through a flat guide plate or sheet 49 to 52 covered with a coating 68 preferably of a synthetic material suitable for influencing the transport fluid flow and/or the ribbon in the desired manner as described above. The coating 68 is applied to that surface of the guide sheet or plate which faces ribbon 1 and along which the transport fluid flows.

Although the invention has been described with reference to specific example embodiments it will be appreciated that it is intended to cover all modifications and equivalents within the scope of the appended claims.

What I claim is:

1. A method for reducing a transporting strain on elongated flat material passing through a treatment chamber, comprising the following steps:

(a) transporting said elongated material with a transporting speed through said treatment chamber having an inlet and an outlet for said elongated material, whereby a transport direction is from said inlet to said outlet, (b) guiding said elongated material at least around one travel direction changing guide means defining a zone where a direction change begins between said inlet and said outlet, (c) forming a space of substantially triangular cross-section bounded by a straight portion of said guide means upstream, as viewed in said transport direction, of said direction change zone, by a nozzle wall, and by said elongated flat material, whereby said straight portion merges, away from said nozzle wall, into a curved portion of said guide means where said direction change zone begins, (d) introducing at least one flowing fluid jet through said nozzle wall into said space of substantially triangular cross-section at least approximately in said transport direction and substantially in parallel to said straight guide means portion upstream of said direction change zone of said travel direction changing guide means as viewed in said travel direction, whereby a force component extending radially to said travel direction around said guide means is substantially reduced to thereby reduce said strain, and (e) imparting to said flowing fluid jet a flow speed corresponding at least to said transporting speed for transporting said elongated material through said chamber.

2. The method of claim 1, wherein said step of introducing comprises blowing a gas for forming said flowing fluid jet for transporting said elongated material.

3. The method of claim 1, wherein said step of introducing comprises blowing a liquid for forming said flowing fluid jet for transporting said elongated material.

4. The method of claim 1, further comprising filling a flowable treatment medium into said treatment chamber independently of said introducing step.

5. The method of claim 4, using as said flowable fluid for transporting said elongated material a first fluid and using as said treatment medium a second fluid, said first and second fluids having substantially the same composition.

6. The method of claim 1, wherein said guiding step comprises guiding said elongated material at least partially around a plurality of guide means, providing each guide means with at least one jet nozzle, and controlling said flow speed of said flowing fluid jets in such a way that at least one flowing fluid jet has a flow speed that differs from other flow speeds.

7. The method of claim 6, wherein said control is performed so that each of said fluid jets has a different flow speed.

8. The method of claim 1, wherein said flow speed is so controlled that a required transport speed for said elongated material is assured at the respective guide means.

9. The method of claim 1, wherein said step of introducing comprises blowing said flowing fluid jet with a jet width across said elongated material, said jet width corresponding to a width of said elongated material.

10. The method of claim 1, wherein said step of introducing comprises blowing said flowing fluid jet with a jet width, as viewed across a material width of said elongated material, which jet width is less than said material width.

11. The method of claim 1, wherein said flow speed is controlled so that different flow speeds are effective along the width of said elongated material.

12. The method of claim 1, wherein said step of introducing comprises forming said flowing fluid jet as a plurality of individual jets along a width of said elongated material, said individual jets having fluid densities which differ along said width of said elongated material.

13. The method of claim 1, wherein said step of introducing comprises producing a plurality of individual fluid jets and directing said individual jets substantially in said transport direction.

14. The method of claim 13, further comprising producing said individual fluid jets to have an approximately circular cross-section.

15. The method of claim 1, wherein said step of introducing comprises producing at least one fluid jet having a flow cross-sectional area that is substantially longer in one direction than in a direction perpendicularly to said one direction.

16. An apparatus for reducing a transporting strain on elongated flat material passing through a treatment operation in a travel direction, comprising a treatment chamber for treating said elongated material, said chamber having an inlet and an outlet defining a transport direction from said inlet to said outlet, means for transporting said elongated material from said inlet to said outlet, said transporting means including at least one material guide means having a curved material guide surface for changing the travel direction of said elongated material between said inlet and said outlet, whereby said material guide means define a direction change zone where a direction change begins, said material guide means further having a straight portion merging into said curved material guide surface, and fluid flow means including a nozzle wall upstream of said straight portion, as viewed in said travel direction, said nozzle wall, said straight portion and said flat material bounding a space of substantially triangular cross-section tapering toward a point where said guide means begin changing said travel direction in said direction change zone for introducing substantially in said travel direction at least one flowing fluid jet into said space of substantially triangular cross-section between said straight portion of said material guide means and said elongated flat material, whereby a force component extending radially of said curved material guide surface is substantially reduced for reducing said strain, said fluid flow means imparting to said flowing fluid a flow speed corresponding at least to a transporting speed of said elongated material.

17. The apparatus of claim 16, wherein said fluid flow means comprise at least one nozzle means directed for blowing a jet of said flowing fluid into a direction change zone where a change in the travel direction of said elongated material begins, said nozzle means being arranged at a spacing (17) upstream of said direction change zone, said guide means having, in addition to said material guide surface, a material contact surface upstream of said material guide surface, said material contact surface spacing said elongated material from said material guide surface to lead said elongated material at a slant toward said direction change zone, thereby forming said wedge space into which said nozzle means blows.

18. The apparatus of claim 17, wherein said nozzle means comprise at least one group of a plurality of individual blow nozzles.

19. The apparatus of claim 18, wherein said individual blow nozzles are arranged substantially across the entire width of said elongated material.

20. The apparatus of claim 18, wherein said individual blow nozzles are arranged substantially in a row along a line, especially a straight line with a spacing between neighboring nozzles so that there is no fluid flow where said spacings are.

21. The apparatus of claim 18, wherein said nozzle means comprise two groups of individual blow nozzles forming two rows of nozzles.

22. The apparatus of claim 18, wherein said individual blow nozzles have different blow influencing characteristics.

23. The apparatus of claim 18, further comprising supply means for supplying pressurized fluid individually and/or in common to said blow nozzles or groups of blow nozzles.

24. The apparatus of claim 23, wherein said supply means for supplying pressurized fluid to said nozzle means comprise a tubular member having at least one flat wall, and wherein said blow nozzles comprise nozzle holes in said one flat wall, said nozzle holes being located close to said material contact surface.

25. The apparatus of claim 24, wherein said tubular member comprises a pipe section of rectangular cross-section, said nozzle holes including a first set of nozzle holes in said pipe section facing in said travel direction upstream of said direction change zone and a second set of nozzle holes in said pipe section facing in said travel direction downstream of said direction change zone.

26. The apparatus of claim 25, wherein said pipe section has a first wall extension (27) in parallel to said first set of nozzle holes and a second wall extension (27*a*) in parallel to said second set of nozzle holes, said wall extension supporting guide wall elements (25, 67) of said guide means.

27. The apparatus of claim 24, wherein said guide means comprise an approximately U-shaped wall member having two guide legs and a curved guide section interconnecting said two guide legs, one guide leg contacting with its leg end said flat wall of said tubular member at a location next to said nozzle holes, the other guide leg contacting said tubular member remote from said nozzle holes, said one guide leg having a surface forming part of said wedge space with said elongated material upstream of said direction change zone, so that said nozzle holes can blow into said wedge space.

28. The apparatus of claim 27, wherein said tubular member has at least two flat walls extending substantially perpendicularly to each other, one of said flat walls having said nozzle holes therein and extending substantially perpendicularly to said travel direction, the other of said flat walls extending substantially in the travel direction, said two guide legs of said U-shaped wall member having a first shorter leg reaching to said one flat wall next to said nozzle holes, and a second longer leg extending in parallel to the other flat wall of said tubular member.

29. The apparatus of claim 27, wherein said surface of said one guide leg of said U-shaped wall member is inclined toward said direction change zone for influencing the shape of said wedge space.

30. The apparatus of claim 27, wherein said curved guide section (5) of said U-shaped wall member has a semicircular cross-sectional configuration.

31. The apparatus of claim 27, wherein said U-shaped wall member with its curved guide section its guide legs is an integral structure of bent sheet material.

32. The apparatus of claim 31, wherein said integral structure is bent of flat sheet metal.

33. The apparatus of claim 27, wherein said flat wall of said tubular member has a wall extension (27) running in parallel to said nozzle holes and perpendicularly to said flat wall of said tubular member for providing a mounting support for said one guide leg of said U-shaped wall member.

34. The apparatus of claim 27, wherein at least said curved guide section of said U-shaped wall member has grooves in its surface facing said elongated material.

35. The apparatus of claim 27, wherein at least said curved guide section of said U-shaped wall member has a polished surface facing said elongated material.

36. The apparatus of claim 27, wherein at least said curved guide section of said U-shaped wall member has a roughened surface facing said elongated material, said roughened surface having a roughness measured in the micron range.

37. The apparatus of claim 27, wherein at least said curved guide section of said U-shaped wall member has a coated surface with a coating of synthetic material.

38. The apparatus of claim 24, wherein said tubular member comprises connector means for connection to pressurized fluid supply means.

39. The apparatus of claim 24, wherein siad tubular member has a substantially rectangular cross-sectional configuration mounted in said treatment chamber so that ends of said tubular member are sealed against inner surfaces of walls of said treatment chamber.

40. The apparatus of claim 16, further comprising means for measuring said transporting speed of said elongated material to produce transport speed signals, said fluid flow means comprising controllable fluid volume control means, said apparatus further comprising a central processing unit having inputs connected to receive said speed signals and control outputs connected to said fluid volume control means for controlling the supply of fluid in response to said transport speed signals.

* * * * *